US006885155B2

(12) United States Patent
Speirs et al.

(10) Patent No.: US 6,885,155 B2
(45) Date of Patent: Apr. 26, 2005

(54) ARRANGEMENT FOR ACTIVATING A DISPLAY DEVICE WITH VOLTAGE MULTIPLIER

(75) Inventors: Christopher Rodd Speirs, Zürich (CH); Zlatan Gradincic, Arzo (CH)

(73) Assignee: Koninklijke Philips Electronics N.V., Eindhoven (NL)

( * ) Notice: Subject to any disclaimer, the term of this patent is extended or adjusted under 35 U.S.C. 154(b) by 76 days.

(21) Appl. No.: 10/323,345

(22) Filed: Dec. 18, 2002

(65) Prior Publication Data

US 2003/0122503 A1 Jul. 3, 2003

(30) Foreign Application Priority Data

Dec. 20, 2001 (DE) ..... 10162765

(51) Int. Cl.[7] ..... G09G 3/10

(52) U.S. Cl. ..... 315/169.1; 315/169.2; 315/169.3; 345/42; 345/212

(58) Field of Search ..... 315/169.1, 169.2, 315/169.3; 345/30, 42, 90, 95, 100, 204, 210–212

(56) References Cited

U.S. PATENT DOCUMENTS 5,892,504 A * 4/1999 Knapp ..... 345/204
5,956,006 A * 9/1999 Sato ..... 345/88
6,198,466 B1 * 3/2001 Morich et al. ..... 345/95
6,359,389 B1 * 3/2002 Medina et al. ..... 315/169.1

* cited by examiner

*Primary Examiner*—Haissa Philogene
(74) *Attorney, Agent, or Firm*—Kevin Simons

(57) ABSTRACT

The invention relates to an arrangement for activating a display device with rows and columns, in which voltages may be supplied to the rows and columns of the display device as a function of data to be displayed. In addition, the invention relates to a display device having such an arrangement.

Figure 1:
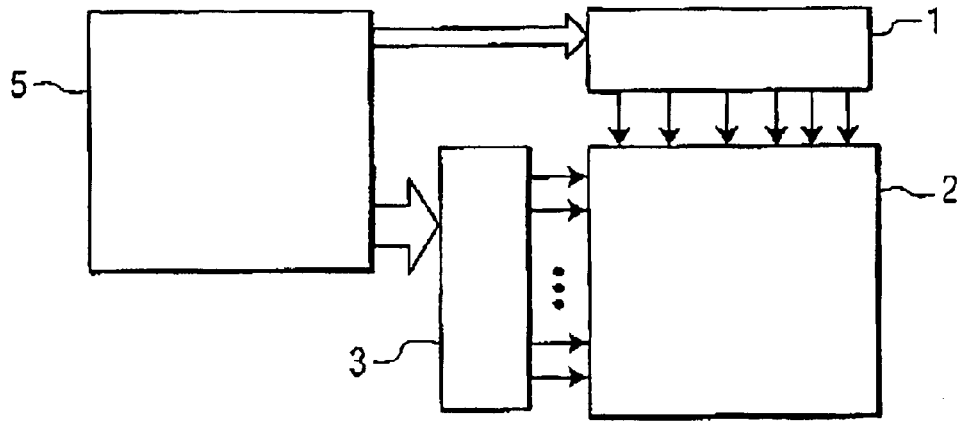

To allow an efficient energy utilization and to avoid inaccuracies, an arrangement for activating a display device with columns and rows is proposed in which voltages (Vcol, Vcol/2, Vss, Vrow+, Vrow−) can be supplied to the rows and columns of the display device (2) as a function of data to be displayed, and the arrangement comprises at least one voltage divider unit (12) and one voltage multiplier unit (11), a supply voltage (Vdd) being supplied to the voltage divider unit, a divided voltage derived from the voltage divider unit being supplied to a voltage multiplier unit, and the divided voltage and the voltage generated by the voltage multiplier unit being supplied to the display device.

5 Claims, 1 Drawing Sheet

ARRANGEMENT FOR ACTIVATING A DISPLAY DEVICE WITH VOLTAGE MULTIPLIER

The invention relates to an arrangement for activating a display device with rows and columns, in which voltages may be supplied to the rows and columns of the display device as a function of data to be displayed. In addition, the invention relates to a display device having such an arrangement.

Over the next few years, display technology will assume an ever more important role in information and communications technology. As an interface between man and the digital world, the display device is of central significance when it comes to the acceptance of modem information systems. Portable devices in particular, such as, for example, notebooks, telephones, digital cameras, and personal digital assistants, cannot operate without using displays. In principle, there are two types of display. These are passive matrix displays on the one hand and active matrix displays on the other hand. Passive displays are a very widespread display technology, which is used, for example, in laptops and cellphones. Passive matrix display technology allows large displays to be obtained, these mostly being based on the STN (super-twisted nematic) effect.

In passive matrix displays, a pixel is influenced in its gray stage by the waveform of the voltages applied to the columns and rows. Different numbers of fixed voltage values are applied to the display device columns, depending on the driver method used. The arrangements for activating the display devices or driver circuits convert the image signals, which are to be displayed on a display, into the corresponding voltages. The image data are stored in memories as digital signals. These digital signals have to be converted into analog signals, such that an appropriate light intensity may be brought to the display by means of an analog voltage. The digital/analog converters necessary for this conversion have to convert digital signals into voltages which range from less than 20 mV to more than 10 V. To activate liquid crystal displays, it is necessary to provide voltages which are a multiple of the supply voltage of the driver circuit. To this end, voltage multiplier circuits are used which conventionally take the form of charge pumps, which are operated with the system supply voltage available and which pump up the system supply voltage to the necessary output voltage through the series connection of pump stages. A pump stage consists of a switching means and a charge storage element. The voltage multipliers are constructed with multiple stages, in accordance with the voltage difference, such that a higher voltage than the supply voltage is generated in dependence on the number of stages.

In order to generate the number of voltages necessary to activate the columns or rows of display devices, in circuits known hitherto for activating the display device the supply voltage is first supplied to a voltage multiplication unit. To activate passive matrix displays, it is necessary to generate a number of voltages with a particular ratio to one another. Once the voltage multiplication unit has multiplied the supply voltage supplied in accordance with the set multiplication factor, this multiplied voltage is supplied to a voltage divider unit, which then optionally generates a plurality of divided voltages. With regard to the voltage levels, the divided voltages are still on the digital level, such that they are regularly fed to an amplifier means. The amplifier then amplifies these divided voltages, such that the column voltage generated by the voltage multiplier may be supplied to the columns and the amplified divided voltage may be supplied to the rows of a display device.

A disadvantage of this known construction is the initial pumping up of the supply voltage, in order then to divide the voltage back down to generate divided voltages therefrom and subsequently to amplify it again.

It is an object of the invention to provide an arrangement for generating voltage for an arrangement for activating a display device in which energy losses and inaccuracies are avoided.

This object is achieved by an arrangement as claimed in claim 1.

The concept on which the invention is based is that fixed voltage ratios are frequently required for activating a display device. In a conventional circuit it is difficult, on the one hand, to set a precise voltage ratio, since many of the components involved such as, for example, the amplifier and also the voltage divider unit exhibit inaccuracies, which cause the voltage ratio to be imprecise and to depend on the supply voltage and environmental influences. On the other hand, this sequence is not very efficient.

An arrangement is therefore proposed in which first a divided voltage generation from the supply voltage is performed, followed by amplification of the divided voltage value. The amplified divided voltage is then supplied to a voltage multiplier unit. This makes it possible to achieve a firmly definable multiplication of the divided voltage, which is independent of the voltage divider unit and the amplifier, since the multiplication is performed on the basis of the divided voltage already generated and changes thus affect only the absolute voltage values and not the ratio of the voltages to one another.

In a preferred embodiment of the invention, three different voltage values are required, which are supplied to the display device, in particular to the columns and rows. The median voltage is precisely half the size of the highest voltage. The supply voltage is first supplied to the voltage divider unit and then amplified. The amplified divided voltage value is supplied to a voltage multiplier, which performs voltage doubling. This architecture ensures that precisely twice the divided voltage is always generated.

A further advantage of the invention ensues from the fact that the high doubled voltage arises only in the voltage multiplier and at the output to the display device. In this way, the remaining circuit components lying upstream of the voltage multiplier may be smaller in size. In the known circuit according to the prior art, both the voltage divider unit and the amplifier had to be designed for the high voltage.

In a further development of the invention, the voltage multiplier amplifies the voltage supplied thereto by a different factor, for example, by a factor of 3.

This produces a further advantage, since it is then possible for the user of such an arrangement for activating a display device to supply the highest column voltage Vcol from outside, while at the same time Vcol/2 can be generated efficiently. It is likewise possible for the voltage Vcol/2 to be supplied from outside and for the voltage multiplier to be used as a voltage halver.

This advantage is needed, for example, in the case of display arrangements, which use two arrangements for activating the columns. In this case, one driver circuit is configured as the master, which provides the highest voltage Vcol/2, and the second driver circuit is used as a slave, for which the voltage Vcol/2 is used as an input in order to generate the maximum column voltage Vcol therefrom by doubling. In this case, it is ensured that the same voltage Vcol/2 is used by both driver circuits.

The voltages Vdd and Vss are supplied to the activating arrangement; upon activation of a display device, all the columns are connected to either Vdd or Vss as a function of the image data supplied. The voltage Vcol/2 is supplied to the arrangement for activating the rows, from which the row voltages Vrow+ and Vrow− are then generated, which are symmetrical to Vcol/2.

The principle of operation of a voltage halver is the reverse of that of a voltage doubler.

Both controlled and uncontrolled voltage multipliers may be used as voltage multipliers, wherein an uncontrolled voltage multiplier only performs a fixed multiplication and is therefore of substantially simpler construction and thus more economical, while still being sufficient for the function required here. Uncontrolled voltage multipliers may also be realized with different factors.

The object is also achieved by a display device, which uses an above-described activating arrangement.

In portable devices in particular, it is necessary to use components operating as efficiently as possible, since the period of use of the device is influenced decisively by its energy consumption, and thus every energy saving brings with it an extension of the period of use or a reduction in battery capacity, thereby achieving a weight reduction. The development according to the invention operates more efficiently with regard to energy consumption. Moreover, smaller components may be used.

Figure 2:
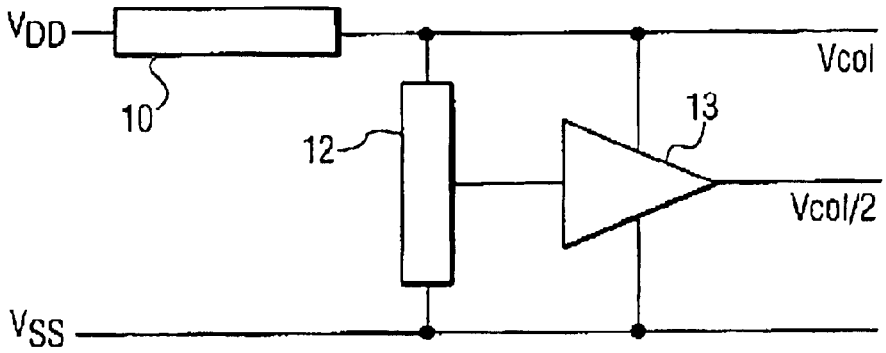
FIG. 2 PRIOR ART

The invention will be further described with reference to embodiments shown in the drawings to which, however, the invention is not restricted. In the Figures:

FIG. 1: shows a block diagram for activating a display arrangement;

FIG. 2: shows a driver circuit according to the prior art; and

Figure 3:
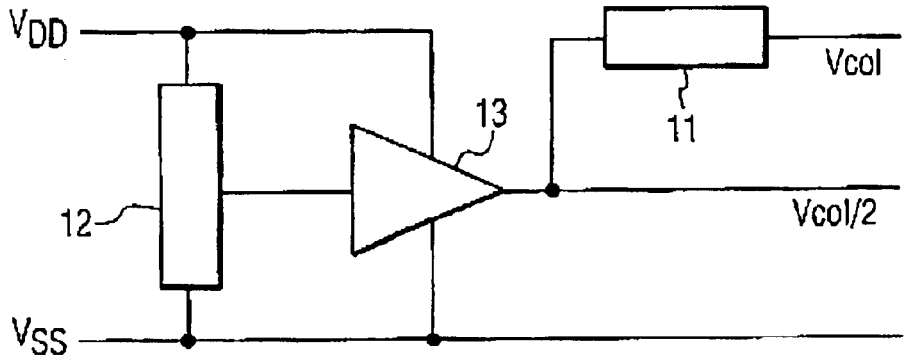

FIG. 3: shows a driver circuit according to the invention.

FIG. 1 shows a block diagram for activating a display 2. The data to be displayed are stored in the unit 5 or are generated thereby. In unit 5, the necessary waveforms are also generated, which are supplied to the columns and rows of the display device. At least one column driver 1 and one row driver 2 are associated with the display 2.

For an arrangement for activating a display device or a driver circuit for passive matrix displays, which operates by the known Alt & Pleshko method, two voltages Vss, Vcol are required for the columns and three voltages Vcol/2, Vrow+, Vrow− for the rows. The values of these voltages are typically Vss=0V, Vcol=4V, Vcol/2=2V, Vrow+=20V, Vrow−=−16V.

FIG. 2 shows a prior art arrangement for activating a display device. It shows in particular the generation of voltage ratios (Vss, Vcol, Vcol/2) in a form used hitherto. The voltages Vdd and Vss are supplied to the arrangement. A voltage multiplier 10 multiplies the supplied voltage Vdd, which is in turn supplied to a divided voltage generating unit 12. A divided voltage in accordance with the appropriate ratio is generated from the generated column voltage Vcol and supplied to the amplifier 13. At its output, the amplifier 13 outputs the amplified voltage Vcol/2 for supply to the row driver circuit of the display device. It is clear that all the components 10, 12 and 13 have to be designed for the multiplied voltage Vcol. In addition, a pumped-up voltage Vcol is divided down again in the divided voltage generating unit 12 and subsequently amplified again.

FIG. 3 shows an arrangement according to the present invention. The supply voltage Vdd is supplied to the divided voltage generating unit 12 and the amplifier 13. From the supply voltage Vdd, the divided voltage generating unit 12 generates a divided voltage which is supplied to the amplifier 13, which generates the voltage Vcol/2 therefrom. The voltage Vcol/2 is now supplied to the voltage multiplier 11, which generates the column voltage Vcol therefrom.

The voltage multiplier may also multiply by the factor 3 or more. The ratio of the voltages to be generated depends on the driver method used.

The arrangement for generating voltages may also be used in other driver circuits, for example in MRA driver circuits. It may in principle be used wherever symmetrical voltage ratios are required.

What is claimed is:

1. An arrangement for activating a display device with columns and rows, in which voltages (Vcol, Vcol/2, Vss, Vrow+, Vrow−) are supplied to the rows and columns of the display device (2) as a function of data to be displayed, and the arrangement comprises at least one voltage divider unit (12) and one voltage multiplier unit (11), wherein a supply voltage (Vdd) is supplied to the voltage divider unit, a divided voltage derived from the voltage divider unit is supplied to a voltage multiplier unit, and the divided voltage and the voltage generated by the voltage multiplier unit are supplied to the display device.

2. An arrangement as claimed in claim 1, characterized in that an amplifier unit (13) is provided, which is provided for amplification of the divided voltage generated by the voltage divider unit, while a definable multiplication of the amplified divided voltage is generated by means of the voltage multiplier unit.

3. An arrangement as claimed in claim 1, characterized in that, to generate three fixed voltage values which are provided for supply to the display device, first a generation of a divided voltage frora a supply voltage is provided, followed by multiplication of this divided voltage by means of a voltage multiplier unit.

4. An arrangement as claimed in claim 1, characterized in that the voltage multiplier unit performs a doubling of the supplied divided voltage.

5. An arrangement as claimed in claim 1, characterized in that an uncontrolled voltage multiplier may be used as the voltage multiplier.

* * * * *